US006915578B2

(12) United States Patent
Yusufov et al.

(10) Patent No.: US 6,915,578 B2
(45) Date of Patent: Jul. 12, 2005

(54) REVERSIBLE SCISSORS

(76) Inventors: Salman Yusufov, 1439 Ocean Ave. #5D, Brooklyn, NY (US) 11230; Nazim Yusufov, 1439 Ocean Ave. #5D, Brooklyn, NY (US) 11230

( * ) Notice: Subject to any disclaimer, the term of this patent is extended or adjusted under 35 U.S.C. 154(b) by 0 days.

(21) Appl. No.: 10/419,628

(22) Filed: Apr. 21, 2003

(65) Prior Publication Data

US 2004/0211068 A1 Oct. 28, 2004

(51) Int. Cl.[7] ..... B26B 13/20
(52) U.S. Cl. ..... 30/232; 30/256
(58) Field of Search ..... 30/231, 232, 255, 30/256, 260, 341

(56) References Cited

U.S. PATENT DOCUMENTS 187,713 A * 2/1877 Kelly ..... 30/256
242,000 A * 5/1881 Klaucke ..... 30/341
300,153 A * 6/1884 Starks ..... 30/256
1,479,908 A * 1/1924 Goshia ..... 30/341
2,192,725 A * 3/1940 Williams ..... 30/255
2,744,324 A * 5/1956 Chuba ..... 30/271
3,825,020 A * 7/1974 Myers ..... 132/200
3,906,630 A * 9/1975 Megna ..... 30/260
5,007,170 A * 4/1991 Mayama ..... 30/232
5,722,171 A * 3/1998 Schmidt ..... 30/255

* cited by examiner

*Primary Examiner*—Hwei-Siu Payer

(57) ABSTRACT

A reversible scissors comprising a pair of pivotally connected two edge cutting blade members, operating handles and ring members. Ring members are connected pivotally with and movable along the operating handles.

2 Claims, 3 Drawing Sheets

1d
7'd
3d
2d
7d
4d
13d 8d
3d
13d 4d
10d

12'e
12e 3e
14
9e
8e
19
18
18
14
9e
12e
12'e
2e
3e
13e
13'e
19

12'e
12e
9e
14
1e 4e
11e
15
10e

REVERSIBLE SCISSORS

BACKGROUND OF THE INVENTION

The present invention relates to a reversible instruments, and more particularly to an improved reversible scissors and shears having pair of two edge cutting blades.

Such reversible scissors are known in the art and described, for example, in U.S. Pat. No. 300,153. This invention relates to the scissors and shears; and it is for its object to provide the same with reversible handles, whereby both edges of the scissors or shears may be sharpened and employed for cutting purposes by reversing the position of one of the handles around a horizontal axis.

However, this construction of instruments has limitation for usage a reversible scissors having crane position of handles (or rings) concerning the cutting blades which may change-over to opposing and offset. Moreover, this construction cannot be used for reversible scissors which have small sizes, for example, cuticle scissors.

SUMMARY OF THE INVENTION

Accordingly, it is one object of the present invention to provide a reversible scissors which avoids the disadvantages of the prior art.

In keeping with this object and with others which will become apparent hereinafter one feature of the present invention resides, briefly stated in a reversible scissors having a pair of two edge cutting blade members with operating handles and ring members of improved construction, which can be reversed for both of following reasons;-to provide another and sharp cutting edges and/or to be readily adapted to right as well as left handed persons.

The improvement also consists of the novel feature, details of construction, and combination of parts the reversible scissors which may have change-over position of ring members to opposing, offset and crane concerning the cutting blade members and handles.

The novel feature of the present invention will be defined in the claims.

The invention itself, however, will be best understood from the following description which is accompanied by the drawings.

DESCRIPTION OF PREFERED EMBODIMENTS

Figure 1:
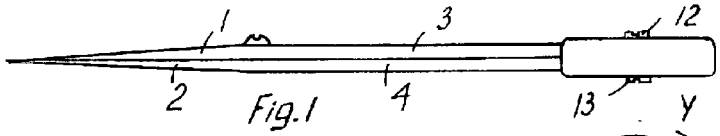
FIGS. 1, 8, 12, 14 are longitudinal views of the reversible scissors in accordance with the present invention.
Figure 2:
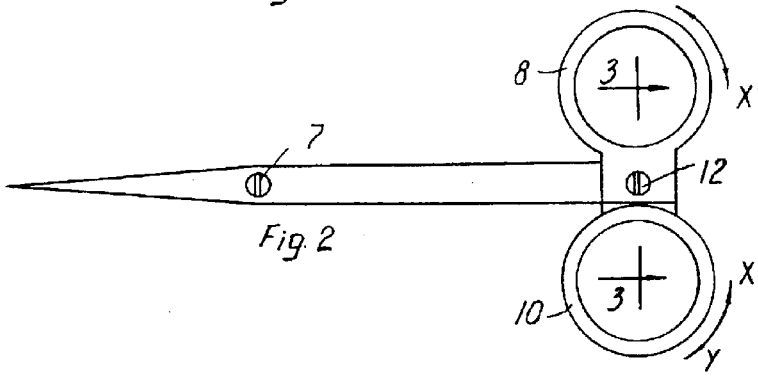
FIGS. 2, 9, 13, 15 are vertical views of FIGS. 1, 8, 12, 14.
Figure 3:
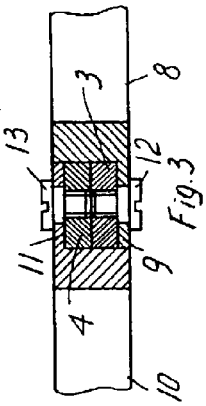
FIG. 3 is a fragmentary cross-sectional view on the line 3—3 of FIG. 2 on an enlarged scale.
Figure 4:
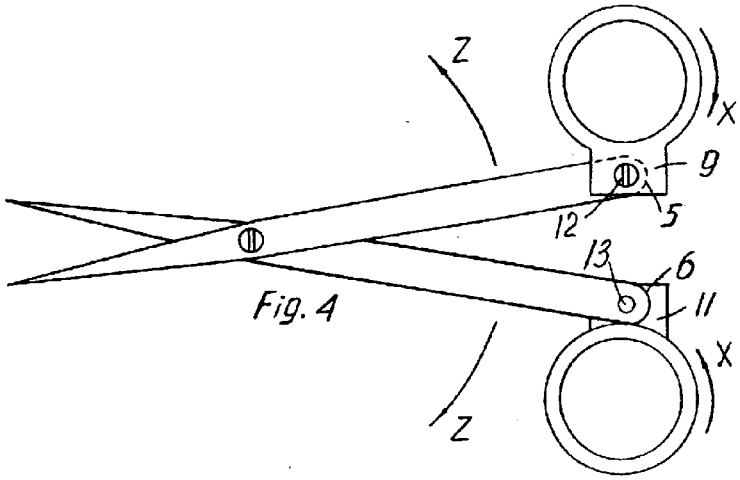
FIG. 4 is a vertical view illustrating the scissors in open position.

A reversible scissors in accordance with the present invention has a pair of two edge cutting blade members 1,2 (FIGS. 1 to 4) having operating handles 3,4 pivotally connected by screw 7, and a pair of ring members 8,10. Handles 3,4 have a segmental form heads 5,6 and ring members with their necks 9,11 pivotally connected with handles by screws 12,13 respectively, so that the ring member 8 may turn around a pivot 12 and the ring member 10 may turn around the pivot 13. Cutting blade members are preferably of concavo-convex form, the inner opposing sides or faces being hollow.

When a user opens a scissors ring members 8,10 turn to the opposite direction Y. When the user closes the scissors ring members turn to the opposite direction X and return at initial position.

Figure 5:
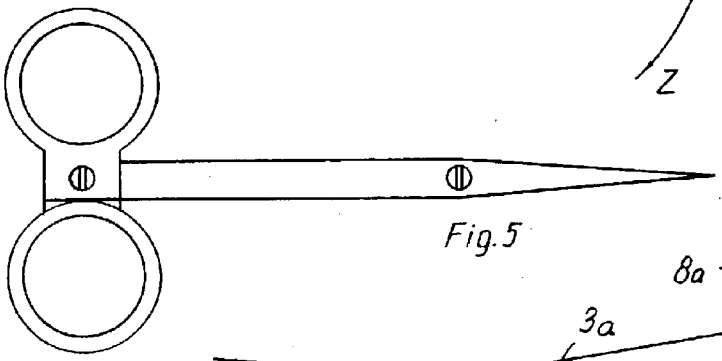
FIGS. 5, 11, 16 are vertical views of the reversed scissors for utilize other pair of cutting edges, or adjusted for left handed persons.

In order to reverse the scissors so as to utilize the other pair of cutting edges, operating handles are reversed by 360 degrees to the opposite direction Z around the pivot 7, and each ring member is reversed by 180 degrees to the opposite direction X around the pivot 12,13. In FIG. 5 is shown reversed scissors to provide another and sharp cutting edges and/or adapted to left handed persons.

Figure 6:
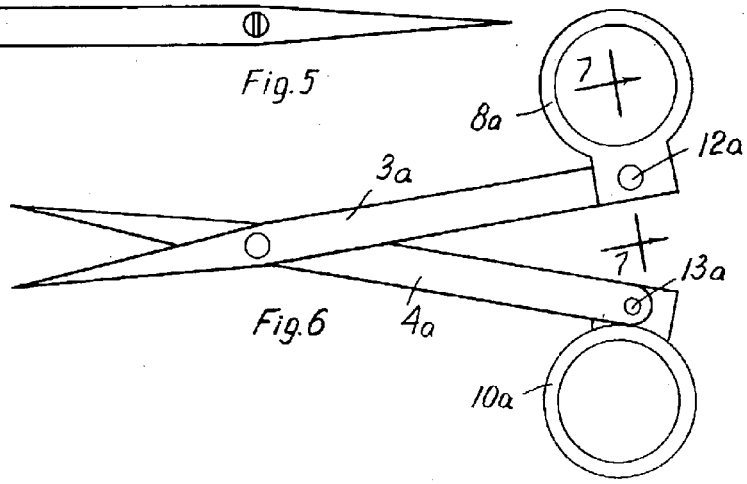
FIGS. 6, 17 are views similar to FIGS. 2, 9, 13, 15 and modified form of the invention.
Figure 7:
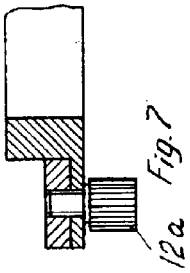
FIG. 7 is a fragmentary cross-sectional view on the line 7—7 of FIG. 6 on an enlarged scale.

The reversible scissors may have thumb screws 12*a*,13*a* (FIGS. 6, 7) for fastening ring members 8*a*,10*a* to operating handles 3*a*,4*a* respectively. It is necessary to loose thumb screws 12*a*,13*a* for reversing the scissors to utilize the other pair of cutting edges.

Figure 8:
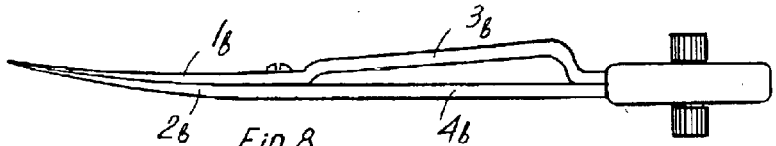
Figure 9:
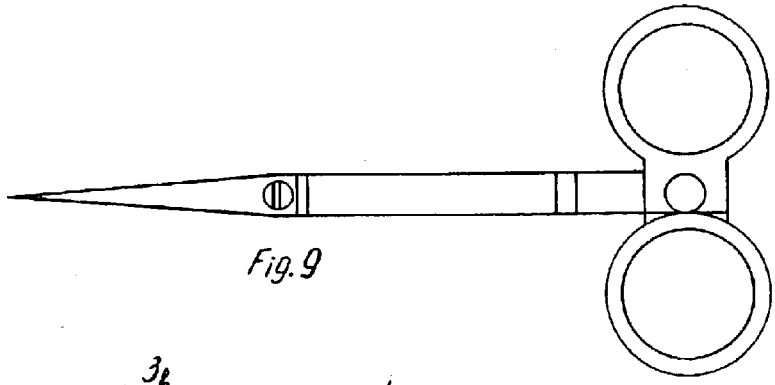
Figure 10:
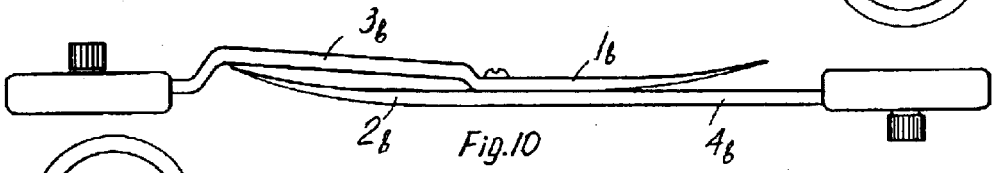
FIG. 10 is a longitudinal view of the reversible scissors in the half reversed position.
Figure 11:
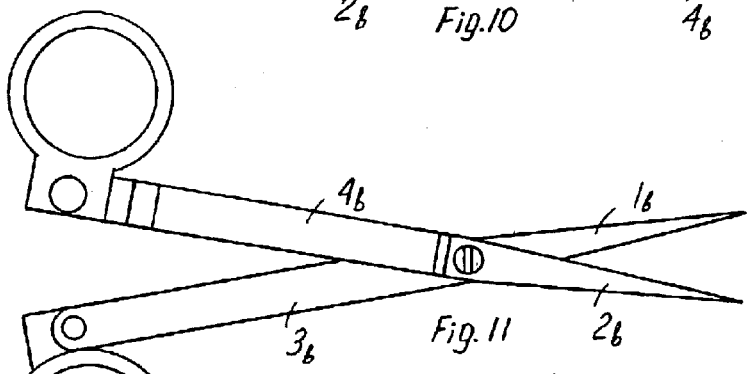

The reversible scissors may have a curved pair of two edge cutting blade members 1*b*,2*b* (FIGS. 8, 9) with operating handles 3*b*,4*b* which one of handles 3*b* is formed an arch for possibility to reverse the scissors. In FIG. 10 is shown cutting blade members 1*b* and 2*b* are disposed against handles 3*b* and 4*b* in relation for reversing. In FIG. 11 is shown the reversible scissors in reversed open position.

Figure 12:
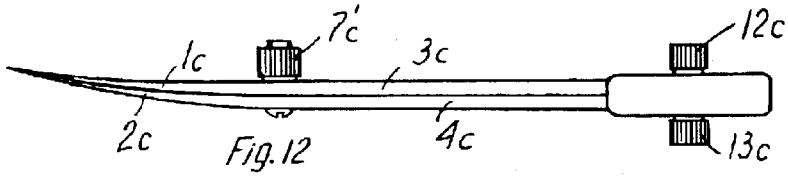
Figure 13:
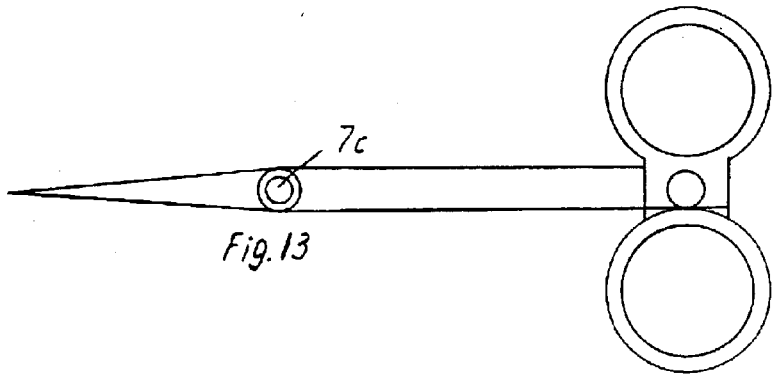

The reversible scissors may have a curved pair of two edge cutting blade members 1*c*, 2*c* (FIGS. 12, 13) with operating handles 3*c*,4*c* pivotally connected by screw 7*c* and thumb nut 7'*c*. In this case, in order to reverse scissors the thumb nut 7'*c* must detached from screw 7*c*, screws 12*c* and 13*c* loosened.

Figures 14, 15, 16, 17, 18, 19, 20, 21, 22, 23:
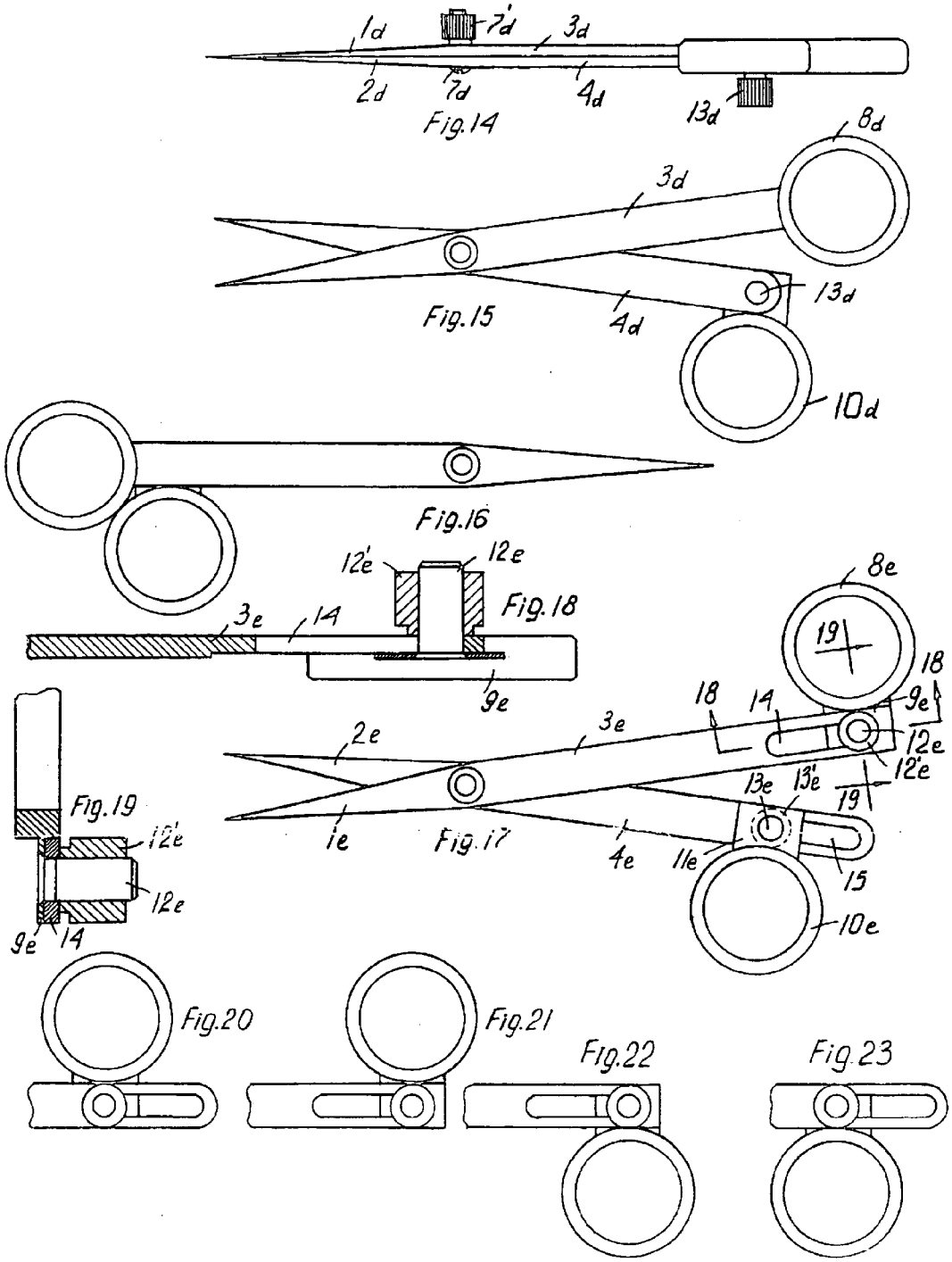
FIGS. 18, 19 are fragmentary cross-sectional views on the line 18—18, 19—19 of FIG. 17 on an enlarged scale.
FIGS. 20 to 23 are fragmentary views of the reversible scissors.

The reversible scissors may be with crane position of ring members concerning the cutting blade members and handles change-over to opposing and offset, and may have a two edge cutting blade member 2*d* (FIGS. 14–15) with operating handle 4*d* pivotally connected by screw 7*d* and thumb nut 7'*d*. A ring member 8*d* is formed integral with the handle 3*d* and the ring member 10*d* is fastened to the handle 4*d* by thumb screw 13*d*. It is necessary to loose the thumb nut 7'*d* and thumb screw 13*d* for reversing scissors. In FIG. 16 is shown the reversible scissors in reversed close position which adapted for left handed persons, or for use sharp pair of cutting edges.

The reversible scissors may be with offset position of ring members concerning the cutting blade members and handles change-over to opposing and crane, and may have a pair of two edge cutting blade members 1*e*,2*e* (FIGS. 17 to 19) with operating handles 3*e*, 4*e* have longitudinal slots 14,15 and traveling ring members 8*e*,10*e*. The screw 12*e* is rigidly fixed with the neck 9*e* of the ring member 8*e* and the screw 13*e* is rigidly fixed with the neck 11*e* of the ring member 10*e*. Traveling ring members 8*e*,10*e* may be fastened to handles 3*e*,4*e* by thumb nut 12'*e*,13'*e* in different position of longitudinal slots 14,15, allow to use the reversible scissors into position for convenient combination of ring members: offset, opposing or crane and adapt to right or left handed persons. In FIGS. 20 to 23 are shown different position of traveling ring members in relation to handle.

What is claimed is:

1. A reversible scissors comprising a pair of pivotally connected two edge cutting blades, each blade has two cutting edges, operating handles and rings in which at least one of said rings is connected pivotally around a vertical axis with and movable along a respective one of said handles, in which each said handle is provided with a longitudinal slot and each said ring is fastened to the handle.

2. A reversible scissors comprising a pair of pivotally connected two edge cutting blades, each blade has two cutting edges, operating handles and rings in which at least one of said rings is connected pivotally around a vertical axis with and movable along a respective one of said handles, in which said blades are curved and one of said handles is arched.

* * * * *